US007321336B2

(12) United States Patent
Phillips et al.

(10) Patent No.: US 7,321,336 B2
(45) Date of Patent: Jan. 22, 2008

(54) MOBILE WIRELESS COMMUNICATIONS DEVICE INCLUDING A WRAP-AROUND ANTENNA ASSEMBLY AND RELATED METHODS

(75) Inventors: Robert Phillips, Waterloo (CA); Yihong Qi, St. Agatha (CA); Ying Tong Man, Waterloo (CA)

(73) Assignee: Research in Motion Limited, Ontario (CA)

( * ) Notice: Subject to any disclaimer, the term of this patent is extended or adjusted under 35 U.S.C. 154(b) by 0 days.

(21) Appl. No.: 11/554,874

(22) Filed: Oct. 31, 2006

(65) Prior Publication Data

US 2007/0109204 A1 May 17, 2007

Related U.S. Application Data

(60) Provisional application No. 60/732,072, filed on Nov. 1, 2005.

(51) Int. Cl.
*H01Q 1/24* (2006.01)

(52) U.S. Cl. ..... 343/702; 343/906

(58) Field of Classification Search ..... 343/702, 343/906; 439/188, 916

See application file for complete search history.

(56) References Cited

U.S. PATENT DOCUMENTS

| | | | | |
|---|---|---|---|---|
| 5,124,889 | A * | 6/1992 | Humbert et al. | 361/818 |
| 5,211,581 | A * | 5/1993 | Schwartz et al. | 439/581 |
| 5,539,417 | A | 7/1996 | Terry et al. | 343/702 |
| 6,448,932 | B1 | 9/2002 | Stoiljkovic et al. | 343/700 MS |
| 6,940,459 | B2 * | 9/2005 | Sullivan et al. | 343/702 |
| 7,023,387 | B2 | 4/2006 | Wen et al. | 343/700 MS |
| 7,119,748 | B2 * | 10/2006 | Autti | 343/702 |
| 7,209,086 | B2 * | 4/2007 | Chung | 343/702 |
| 2003/0098812 | A1 | 5/2003 | Ying et al. | 343/702 |
| 2004/0104856 | A1 | 6/2004 | Stoiljkovic et al. | 343/702 |
| 2005/0026660 | A1 | 2/2005 | Park et al. | 455/575.5 |

FOREIGN PATENT DOCUMENTS

| | | |
|---|---|---|
| WO | WO02/29934 | 4/2002 |
| WO | WO0247197 | 6/2002 |

* cited by examiner

*Primary Examiner*—Tho Phan
(74) *Attorney, Agent, or Firm*—Allen, Dyer, Doppelt, Milbrath & Gilchrist, P.A.

(57) ABSTRACT

A mobile wireless communications device may include a housing, a printed circuit board (PCB) carried by the housing, at least one wireless RF circuit carried by the PCB, and a first contact(s) carried by the PCB and electrically connected to the at least one wireless RF circuit. The device may further include a wrap-around antenna assembly comprising an antenna retainer frame removably coupled to an edge of the PCB and having first and second portions wrapping around adjacent first and second surfaces of the PCB at the edge thereof when the antenna retainer frame is coupled to the PCB. The wrap-around antenna assembly may also include an antenna carried by the antenna retainer frame and extending along the first and second portions thereof. The antenna may include a second contact(s) removably coupled to the first contact(s) when the antenna retainer frame is coupled to the PCB.

23 Claims, 6 Drawing Sheets

MOBILE WIRELESS COMMUNICATIONS DEVICE INCLUDING A WRAP-AROUND ANTENNA ASSEMBLY AND RELATED METHODS

CROSS-REFERENCE TO RELATED APPLICATIONS

This application claims the benefit of U.S. Provisional Application No. 60/732,072, filed Nov. 1, 2005, which is hereby incorporated herein in its entirety by reference.

FIELD OF THE INVENTION

The present invention relates to the field of antennas, and, more particularly, to antennas and antenna mounting fixtures for mobile wireless communications devices and related methods.

BACKGROUND

Mobile wireless communications devices, such as cellular telephones, typically have antennas that support communications in multiple operating frequency bands. Various types of antennas are used for mobile devices, such as helix, "inverted F", folded dipole, and retractable antenna structures, for example. Helix and retractable antennas are typically deployed outside, i.e., on the exterior of, a mobile device (i.e., "exterior antennas"), and inverted F and folded dipole antennas are typically mounted within a mobile device case or housing (i.e., "internal antennas").

Generally speaking, internal antennas are preferred over external antennas for mobile devices for mechanical and ergonomic reasons. Internal antennas are protected by the mobile device case or housing and therefore tend to be more durable than external antennas. External antennas may be cumbersome and make the mobile device difficult to use, particularly in limited-space environments. However, as mobile devices become smaller and thinner, it becomes increasingly more difficult to allocate sufficient surface area for an internal antenna so that it can be of an adequate size (i.e., electrical length) to provide desired operating characteristics.

One particularly advantageous antenna arrangement is set forth in U.S. Pat. No. 7,023,387 to Wen et al., which is assigned to the assignee of the present invention. This patent is directed to a multi-band antenna having a plurality of operating frequency bands. The antenna is mounted on a mounting structure, which may then advantageously be connected to a portion of a mobile wireless communications device, such as the housing. Thus, the antenna need not be located on the main printed circuit board (PCB), which may advantageously free up surface area on the PCB for other components and also allow for increased antenna surface area on the mounting structure.

While the foregoing system may provide desired antenna area and space savings in many mobile wireless communications devices, as device form factors continue to evolve it may be desirable to provide new antenna assemblies and configurations as well.

DETAILED DESCRIPTION

Figure 1:
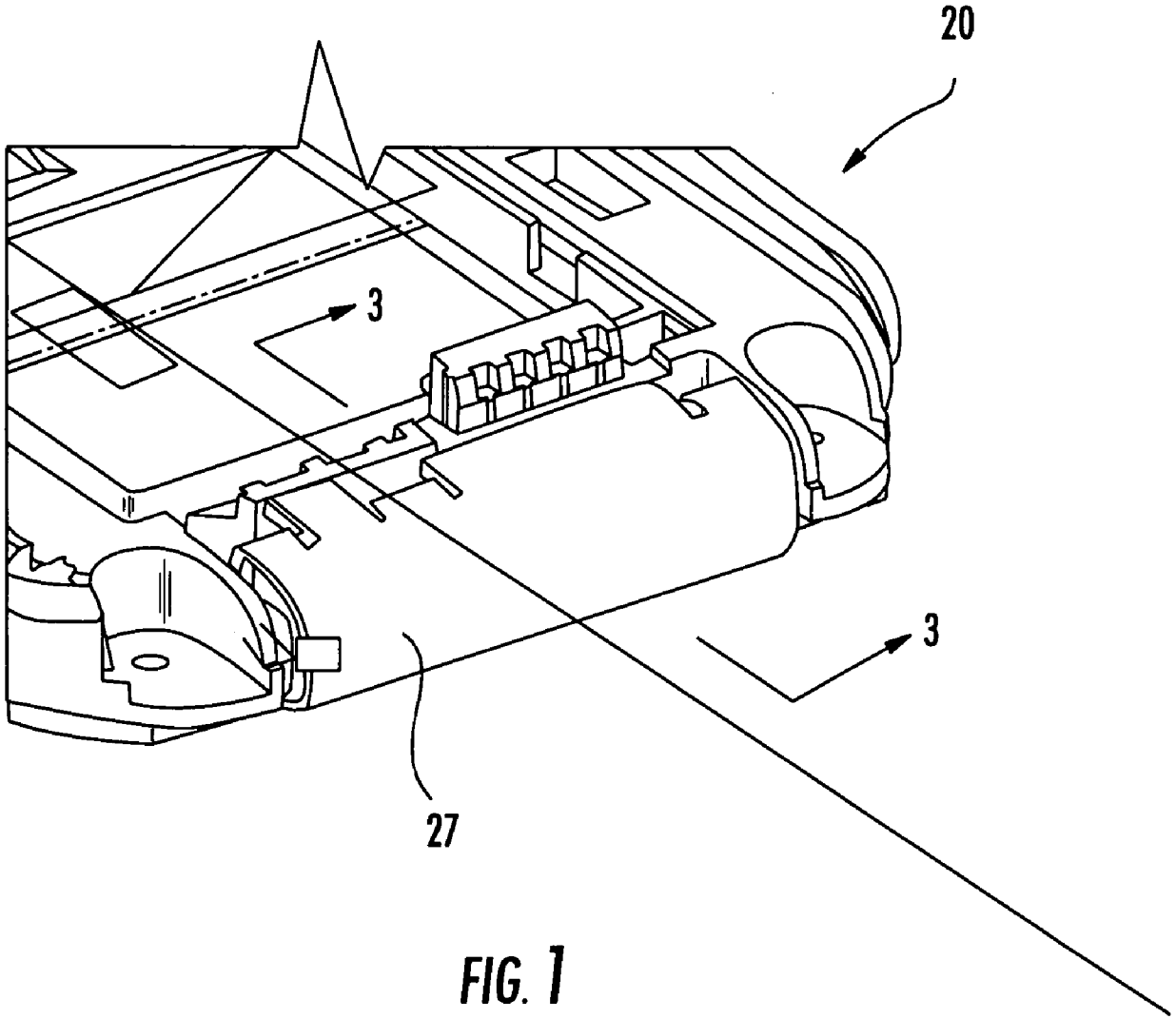
FIG. 1 is a perspective view of the bottom of a mobile wireless communications device with its housing removed to show a device printed circuit board (PCB) and a wrap-around antenna assembly removably coupled thereto of the device.

The present description is made with reference to the accompanying drawings, in which preferred embodiments are shown. However, many different embodiments may be used, and thus the description should not be construed as limited to the embodiments set forth herein. Rather, these embodiments are provided so that this disclosure will be thorough and complete. Like numbers refer to like elements throughout.

Generally speaking, a mobile wireless communications device is disclosed herein which may include a housing, a printed circuit board (PCB) carried by the housing, at least one wireless RF circuit carried by the PCB, and at least one first contact carried by the PCB and electrically connected to the at least one wireless RF circuit. The device may further include a wrap-around antenna assembly comprising an antenna retainer frame removably coupled to an edge of the PCB and having first and second portions wrapping around adjacent first and second surfaces of the PCB at the edge thereof when the antenna retainer frame is coupled to the PCB. The wrap-around antenna assembly may also include an antenna carried by the antenna retainer frame and extending along the first and second portions thereof. More particularly, the antenna may include at least one second contact removably coupled to the at least one first contact when the antenna retainer frame is coupled to the PCB.

The antenna retainer frame may comprise a dielectric body, for example. Also, the antenna may include a flexible substrate and at least one conductive antenna trace thereon, e.g., a flex circuit. Moreover, the at least one second contact may be at least one contact trace on the flexible substrate. Also, the at least one first contact may comprise at least one spring contact.

By way of example, the antenna retainer frame may have a generally U-shaped cross section. Also, the at least one wireless RF circuit may comprise at least one cellular wireless RF circuit, for example. The at least one wireless RF circuit may also comprise at least one of a wireless RF transmitter and a wireless RF receiver. In addition, the antenna may be carried on an outer surface of the antenna retainer frame.

A method aspect is for making a mobile wireless communications device and may include coupling at least one wireless RF circuit to a printed circuit board (PCB), and providing at least one first contact on the PCB electrically connected to the at least one wireless RF circuit. The method may further include positioning an antenna comprising at least one second contact on an antenna retainer frame extending along first and second portions of the antenna retainer frame. Furthermore, the antenna retainer frame may be removably coupled to an edge of the PCB so that the first and second portions of the antenna retainer frame wrap around adjacent first and second surfaces of the PCB, and so that the at least one second contact is removably coupled to the at least one first contact. The method may further include coupling the PCB and antenna retainer frame to a housing.

Figure 5:
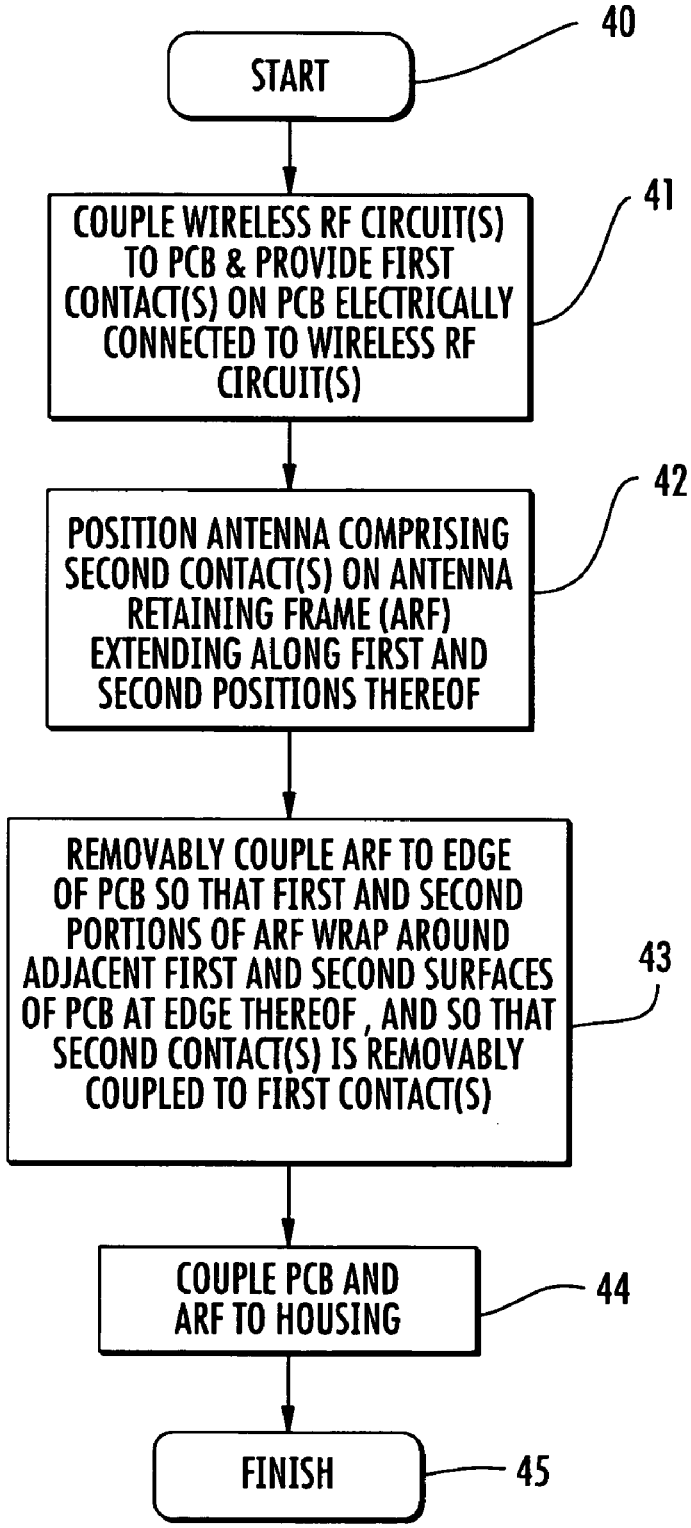
FIG. 5 is a flow diagram illustrating an exemplary method for making a mobile wireless communications device.

Referring initially to FIGS. 1-4, a mobile wireless communications device 20 illustratively includes a housing 21, a printed circuit board (PCB) 22 carried by the housing, and at least one wireless RF circuit carried by the PCB (discussed further with reference to FIG. 5, below). By way of example, the wireless RF circuit may be a cellular transmitter and/or receiver, a wireless local area network (WLAN) transmitter and/or receiver, a satellite positioning receiver (e.g., GPS receiver), etc. A plurality of first contacts 23 are carried by the PCB 22 and are electrically connected to the wireless RF circuit(s). In the illustrated example, there are three such contacts 23, which are surface mount technology (SMT) antenna spring connectors, although other suitable connector types may also be used.

Figure 2:
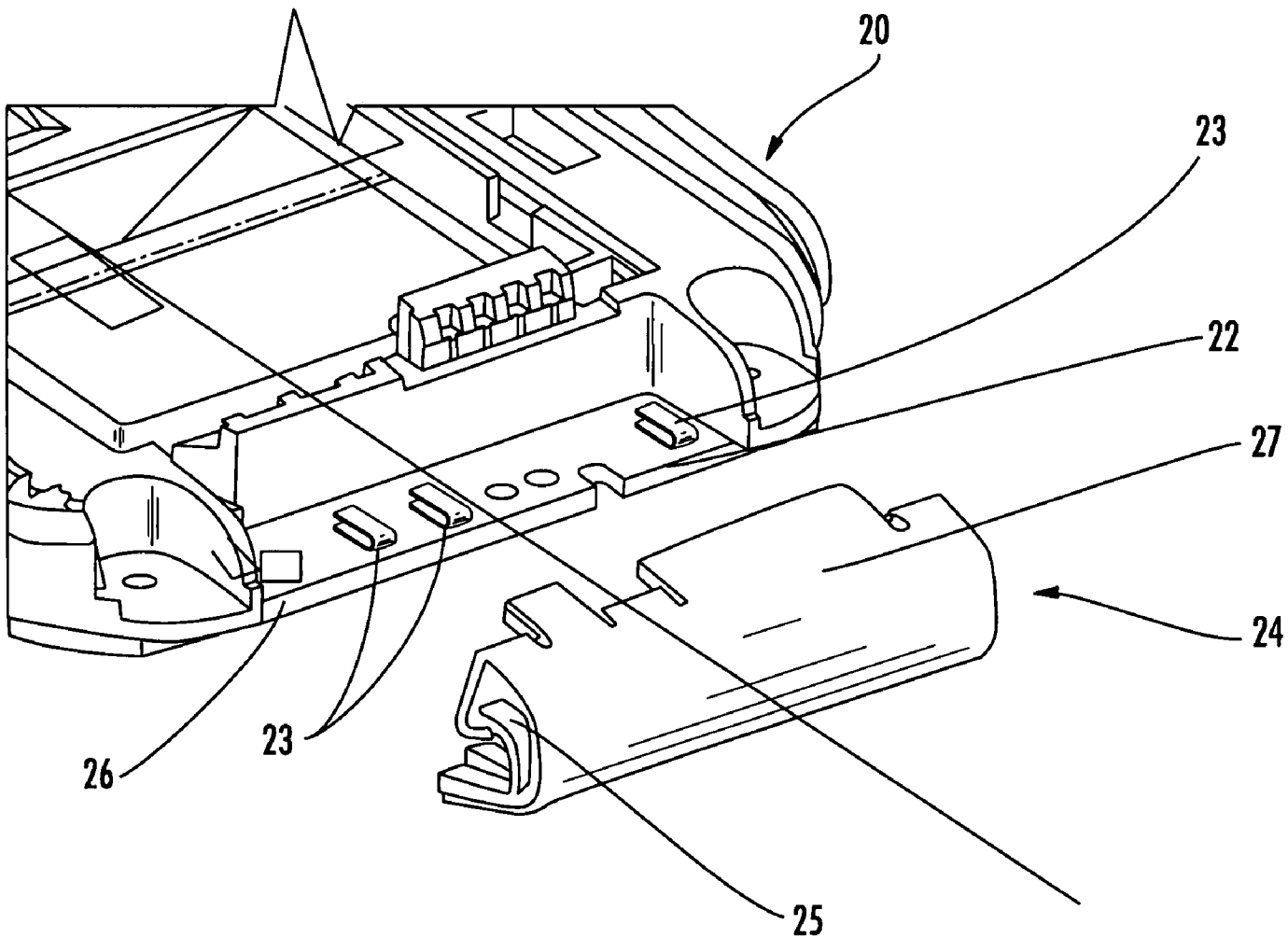
FIG. 2 is a perspective view of the bottom of the mobile wireless communications device of FIG. 1 prior to coupling of the wrap-around antenna assembly to the PCB.
Figure 3:
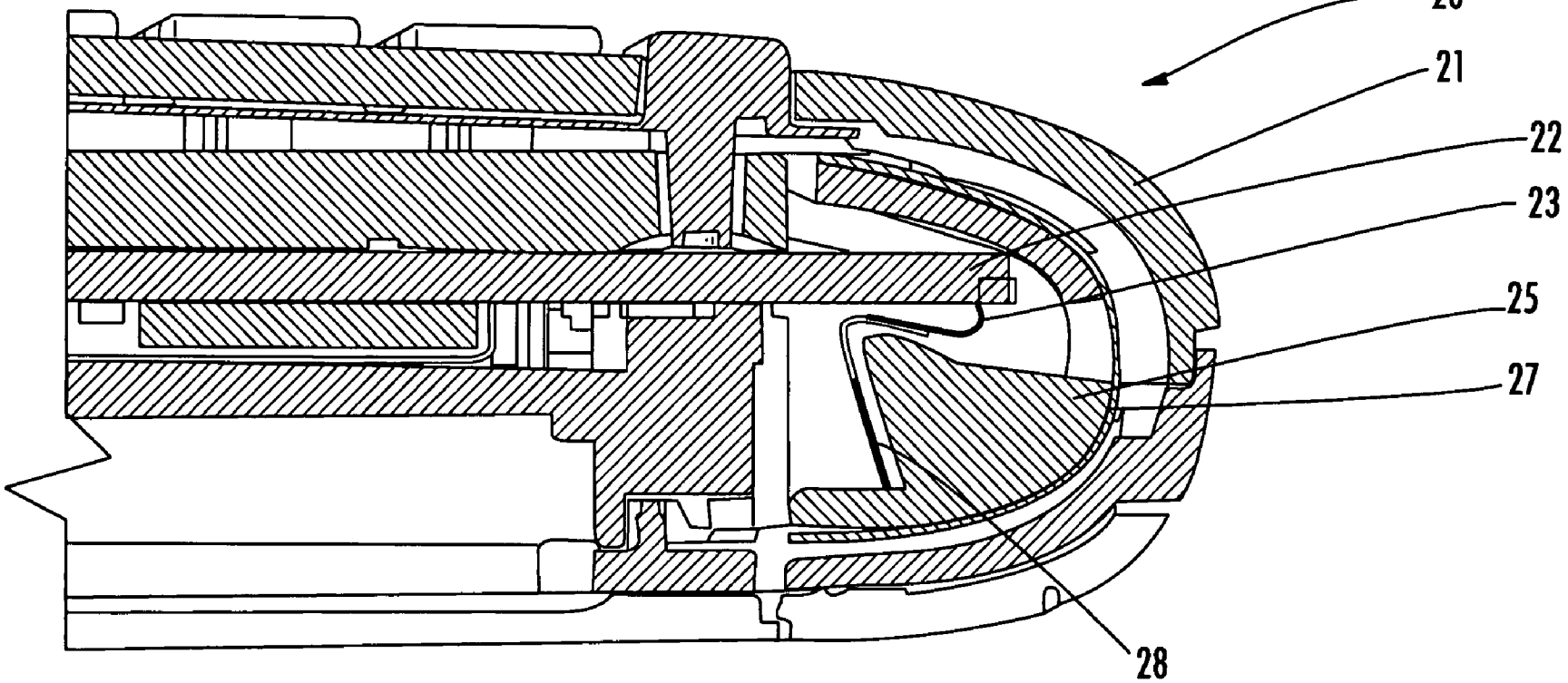
FIG. 3 is cross-sectional view of the mobile wireless communications device of FIG. 1 with a housing.
Figure 4:
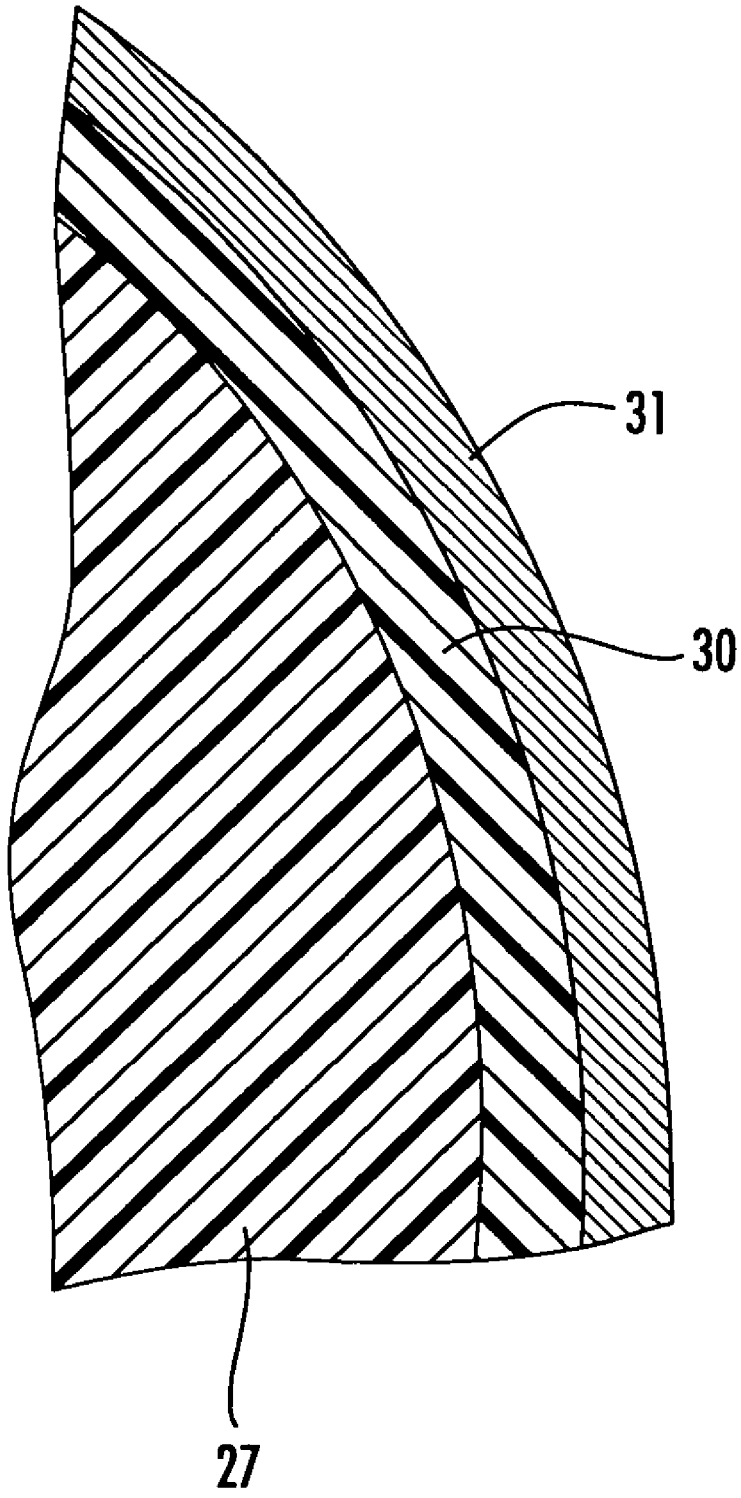
FIG. 4 is a cross-sectional diagram illustrating a portion of the flex circuit antenna and antenna retaining frame of FIG. 3 in greater detail.

The wireless communications device 20 further advantageously includes a wrap-around antenna assembly 24 illustratively including an antenna retainer frame 25 removably coupled (FIG. 1) to an edge 26 of the PCB 22 and having first and second portions wrapping around adjacent first and second surfaces of the PCB at the edge thereof when the antenna retainer frame is coupled to the PCB (FIG. 3). By way of example, the antenna retainer frame 25 may comprise a dielectric, such as plastic, and may be formed by injection molding or other suitable manufacturing techniques known to those skilled in the art. As seen in the example illustrated in FIGS. 2 and 3, the antenna retainer frame 25 has a generally U-shaped cross section, although other shapes are also possible. The antenna retainer frame 25 therefore straddles the top and bottom sides of the PCB 22 upon coupling thereto, advantageously allowing the antenna 27 to be adjacent to or overlie both sides of the board.

The wrap-around antenna assembly 24 also illustratively includes an antenna 27 carried by the antenna retainer frame 25 and extending along the first and second portions on an outer surface thereof as shown. More particularly, the antenna 27 may be a flex circuit including a flexible substrate 30 and one or more conductive traces 31 on the substrate (FIG. 4), as will be appreciated by those skilled in the art. However, the antenna 27 or portions thereof could also be positioned on other portions of the antenna retainer frame 25 as well (e.g., along the inner surface thereof). The conductive trace(s) 31 may form one or more types of antenna elements for single or multi-band operation, such as those discussed in the Background section above, for example.

The antenna 27 also illustratively includes one or more second contacts 28 removably coupled to the first contact(s) 23 when the antenna retainer frame 25 is coupled to the PCB 22. More particularly, there may be a corresponding second contact 28 for each of the first contacts 23. However, this need not be the case in all embodiments (i.e., one or more first contacts 23 may not be connected to the antenna 27 and/or wireless RF circuit(s) in all embodiments.) In particular, each second contact may be a contact trace on the flexible substrate that is positioned to align with a corresponding first contact 23 when the antenna retainer frame 25 is coupled to the PCB 22. In some embodiments, the second contact trace could be an extension of the conductive antenna trace, i.e., it need not be a separate trace, although such a configuration is possible as well.

The wrap-around antenna assembly 24 advantageously provides a compact, flexible printed circuit antenna assembly that is well suited for use as an internal antenna in the mobile wireless communications device 20. The wrap-around antenna assembly 24 allows for relatively easy installation and connection of the antenna 27 to the PCB 22, as will be appreciated by those skilled in the art. However, the antenna retainer frame 25 also advantageously allows the antenna 27 to utilize a significant portion of the available internal space within the housing 21 of the mobile device 20. In particular, the antenna retainer frame 25 allows use of the space on both the top and bottom sides of the PCB 27 for the antenna 27, not just the space available on the antenna's connector side of the PCB 22 (i.e., the top side in the illustrated example).

The structure illustrated in FIGS. 1-3 advantageously has a "U" shaped frame 25 that is pressed or snapped in place such that part of the frame overlies the front side of the PCB 22, and another part of the frame overlies the back side of the PCB (FIG. 1). Moreover, the connection of the antenna to the PCB is self-connecting, by virtue of the mechanical alignment of the frame, and it advantageously reduces the deflection of the springs to protect them from over-bending during assembly or if an impact to the device 20 occurs. By way of contrast, some internal antenna assemblies use a frame and flex circuit held against a single side of the PCB using snaps in which gold pads on the PCB are electrically connected to the antenna flex circuit by small SMT springs. But because these structures snap from one side of the board, they only permit use of the space available on that side.

A method for making a mobile wireless communications device 20 is now described with reference to FIG. 5. Beginning at Block 40, the method illustratively includes positioning at least one wireless RF circuit on a PCB 22, and providing at least one first contact 23 on the PCB and electrically connected to the at least one wireless RF circuit, at Block 41. The method further illustratively includes positioning an antenna 27 comprising at least one second contact 28 on an antenna retainer frame 25 extending along the first and second portions thereof, at Block 42. It should be noted that the steps illustrated in Blocks 41 and 42 may be performed at different locations and in different orders. That is, the PCB 22 and wrap-around antenna assembly 24 components could be manufactured at different facilities and then assembled in the final mobile wireless communications device at a device assembly facility, for example.

Furthermore, the antenna retainer frame 25 is removably coupled to an edge 26 of the PCB 22 so that the first and second portions of the antenna retainer frame wrap around adjacent first and second surfaces of the PCB, and so that at least one second contact 28 is removably coupled to the at least one first contact 23, at Block 43. The PCB 22 and antenna retainer frame 25 are then positioned within or coupled to a housing 21, at Block 44, thus concluding the illustrated method (Block 45).

Exemplary components of a hand-held mobile wireless communications device 1000 in accordance with one exemplary embodiment are now described with reference to FIG. 6. The device 1000 illustratively includes a housing 1200, a keypad 1400 and an output device 1600. The output device shown is a display 1600, which is preferably a full graphic LCD. Other types of output devices may alternatively be utilized. A processing device 1800 is contained within the housing 1200 and is coupled between the keypad 1400 and the display 1600. The processing device 1800 controls the operation of the display 1600, as well as the overall operation of the mobile device 1000, in response to actuation of keys on the keypad 1400 by the user.

The housing 1200 may be elongated vertically, or may take on other sizes and shapes (including clamshell housing structures). The keypad may include a mode selection key, or other hardware or software for switching between text entry and telephony entry.

Figure 6:
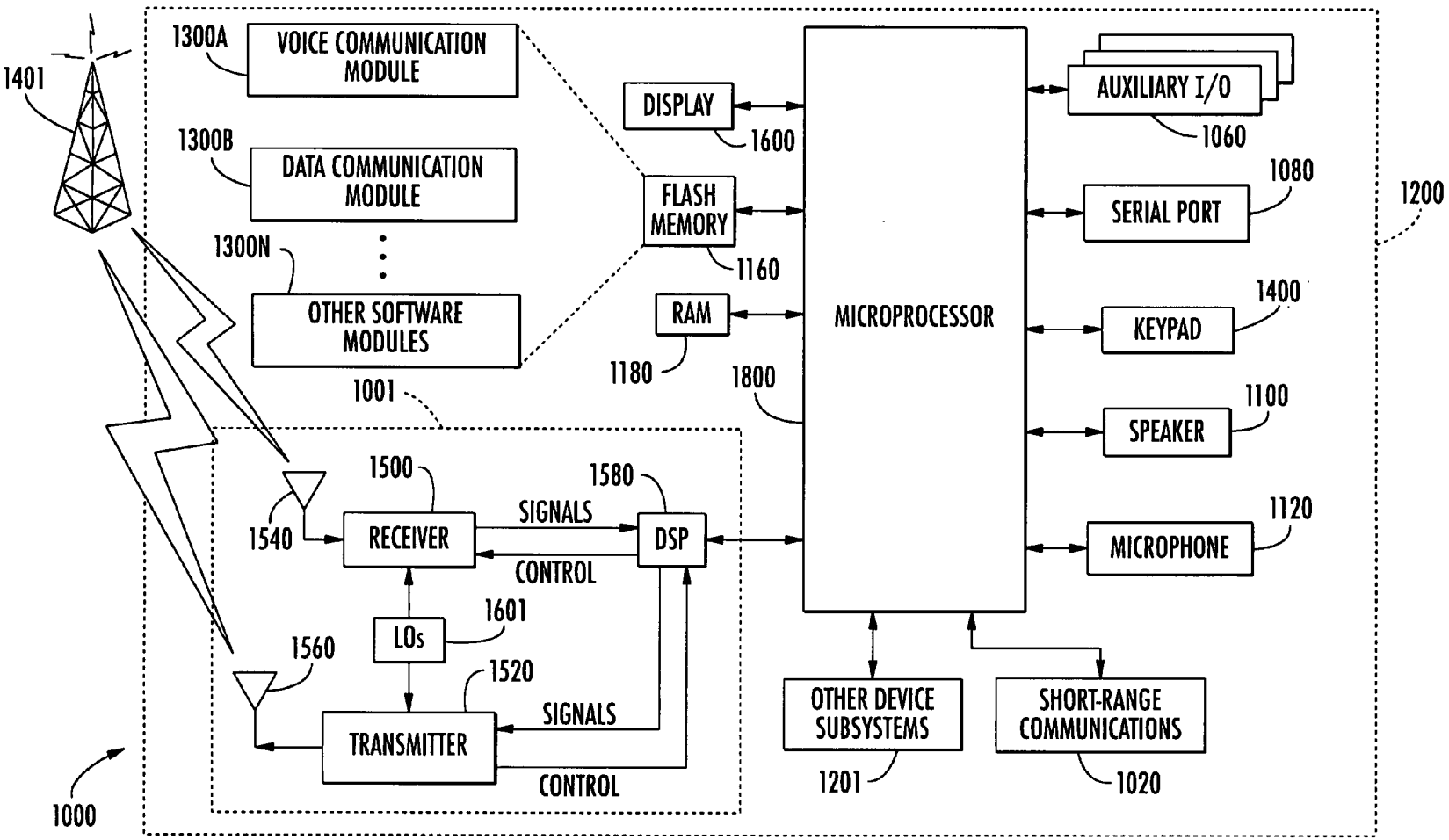
FIG. 6 is a schematic block diagram illustrating additional components of an exemplary mobile wireless communications device in which the wrap-around antenna assembly shown in FIG. 1 may be used.

In addition to the processing device 1800, other parts of the mobile device 1000 are shown schematically in FIG. 6. These include a communications subsystem 1001; a short-range communications subsystem 1020; the keypad 1400 and the display 1600, along with other input/output devices 1060, 1080, 1100 and 1120; as well as memory devices 1160, 1180 and various other device subsystems 1201. The mobile device 1000 is preferably a two-way RF communications device having voice and data communications capabilities. In addition, the mobile device 1000 preferably has the capability to communicate with other computer systems via the Internet.

Operating system software executed by the processing device 1800 is preferably stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (RAM) 1180. Communications signals received by the mobile device may also be stored in the RAM 1180.

The processing device 1800, in addition to its operating system functions, enables execution of software applications 1300A-1300N on the device 1000. A predetermined set of applications that control basic device operations, such as data and voice communications 1300A and 1300B, may be installed on the device 1000 during manufacture. In addition, a personal information manager (PIM) application may be installed during manufacture. The PIM is preferably capable of organizing and managing data items, such as e-mail, calendar events, voice mails, appointments, and task items. The PIM application is also preferably capable of sending and receiving data items via a wireless network 1401. Preferably, the PIN data items are seamlessly integrated, synchronized and updated via the wireless network 1401 with the device user's corresponding data items stored or associated with a host computer system.

Communication functions, including data and voice communications, are performed through the communications subsystem 1001, and possibly through the short-range communications subsystem. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TAC™ or General Packet Radio Service (GPRS) mobile data communications networks, and also designed to operate with any of a variety of voice communications networks, such as AMPS, TDMA, CDMA, WCDMA, PCS, GSM, EDGE, etc. Other types of data and voice networks, both separate and integrated, may also be utilized with the mobile device 1000. The mobile device 1000 may also be compliant with other communications standards such as 3GSM, 3GPP, UMTS, etc.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore requires a subscriber identity module, commonly referred to as a SIN card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device 1060. A device user may also compose data items, such as e-mail messages, using the keypad 1400 and/or some other auxiliary I/O device 1060, such as a touchpad, a rocker switch, a thumb-wheel, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, or a Bluetooth™ communications module to provide for communication with similarly-enabled systems and devices.

Many modifications and other embodiments will come to the mind of one skilled in the art having the benefit of the teachings presented in the foregoing descriptions and the associated drawings. Therefore, it is understood that various modifications and embodiments are intended to be included within the scope of the appended claims.

That which is claimed is:

1. A mobile wireless communications device comprising:

a housing;

a printed circuit board (PCB) carried by said housing;

at least one wireless RF circuit carried by said PCB;

at least one first contact carried by said PCB and electrically connected to said at least one wireless RF circuit; and a wrap-around antenna assembly comprising an antenna retainer frame removably coupled to an edge of said PCB and having first and second portions wrapping around adjacent first and second surfaces of said PCB at the edge thereof when said antenna retainer frame is coupled to said PCB, and an antenna carried by said antenna retainer frame and extending along the first and second portions thereof, said antenna comprising at least one second contact removably coupled to said at least one first contact when said antenna retainer frame is coupled to said PCB.

2. The mobile wireless communications device of claim 1 wherein said antenna retainer frame comprises a dielectric body.

3. The mobile wireless communications device of claim 2 wherein said antenna comprises a flexible substrate and at least one conductive antenna trace thereon.

4. The mobile wireless communications device of claim 3 wherein said at least one second contact comprises at least one contact trace on said flexible substrate.

5. The mobile wireless communications device of claim 1 wherein the at least first contact comprises at least one spring contact.

6. The mobile wireless communications device of claim 1 wherein said antenna retainer frame has a generally U-shaped cross section.

7. The mobile wireless communications device of claim 1 wherein said at least one wireless RF circuit comprises at least one cellular wireless RF circuit.

8. The mobile wireless communications device of claim 1 wherein said at least one wireless RF circuit comprises a wireless RF transmitter.

9. The mobile wireless communications device of claim 1 wherein said at least one wireless RF circuit comprises a wireless RF receiver.

10. The mobile wireless communications device of claim 1 wherein said antenna is carried on an outer surface of said antenna retainer frame.

11. A mobile wireless communications device comprising:

a housing;

a printed circuit board (PCB) carried by said housing;

at least one wireless RF circuit carried by said PCB;

at least one first contact carried by said PCB and electrically connected to said at least one wireless RF circuit; and a wrap-around antenna assembly comprising a dielectric antenna retainer frame removably coupled to an edge of said PCB and having first and second portions wrapping around adjacent first and second surfaces of said PCB at the edge thereof when said dielectric antenna retainer frame is coupled to said PCB, and an antenna comprising a flexible substrate and at least one conductive antenna trace thereon carried on an outer surface of said dielectric antenna retainer frame and extending along the first and second portions thereof, said antenna comprising at least one second contact removably coupled to said at least one first contact when said dielectric antenna retainer frame is coupled to said PCB.

12. The mobile wireless communications device of claim 11 wherein said at least one second contact comprises at least one contact trace on said flexible substrate.

13. The mobile wireless communications device of claim 11 wherein the at least one first contact comprises at least one spring contact.

14. The mobile wireless communications device of claim 11 wherein said dielectric antenna retainer frame has a generally U-shaped cross section.

15. The mobile wireless communications device of claim 11 wherein said at least one wireless RF circuit comprises at least one cellular wireless RF circuit.

16. The mobile wireless communications device of claim 11 wherein said at least one wireless RF circuit comprises at least one of a wireless RF transceiver and a wireless RF receiver.

17. A method for making a mobile wireless communications device comprising:

coupling at least one wireless RF circuit to a printed circuit board (PCB), and providing at least one first contact on the PCB electrically connected to the at least one wireless RF circuit;

positioning an antenna comprising at least one second contact on an antenna retainer frame extending along first and second portions of the antenna retainer frame;

removably coupling the antenna retainer frame to an edge of the PCB so that the first and second portions of the antenna retainer frame wrap around adjacent first and second surfaces of the PCB, and so that the at least one second contact is removably coupled to the at least one first contact; and positioning the PCB and antenna retainer frame within a housing.

18. The method of claim 17 wherein the antenna retainer frame comprises a dielectric body.

19. The method of claim 18 wherein the antenna comprises a flexible substrate and at least one conductive antenna trace thereon.

20. The method of claim 19 wherein the at least one second contact comprises at least one contact trace on the flexible substrate.

21. The method of claim 17 wherein the at least first contact comprises at least one spring contact.

22. The method of claim 17 wherein the at least one wireless RF circuit comprises at least one cellular wireless RF circuit.

23. The method of claim 17 wherein the at least one wireless RF circuit comprises at least one of a wireless RF transmitter and a wireless RF receiver.

* * * * *

UNITED STATES PATENT AND TRADEMARK OFFICE

CERTIFICATE OF CORRECTION

PATENT NO. : 7,321,336 B2
APPLICATION NO. : 11/554874
DATED : January 22, 2008
INVENTOR(S) : Phillips et al.

It is certified that error appears in the above-identified patent and that said Letters Patent is hereby corrected as shown below:

| | |
|---|---|
| Column 2, Line 4 | Delete: "is cross-sectional"<br>Insert: --is a cross-sectional-- |
| Column 4, Line 10 | Delete: "PCB 27"<br>Insert: --PCB 22-- |
| Column 5, Line 39 | Delete: "PIN"<br>Insert: --PIM-- |
| Column 6, Line 6 | Delete: "SIN"<br>Insert: --SIM-- |
| Column 7, Line 33 | Delete: "least first"<br>Insert: --lease one first-- |
| Column 8, Line 54 Claim 20 | Delete: "least first"<br>Insert: --lease one first-- |

Signed and Sealed this

Thirteenth Day of May, 2008

JON W. DUDAS
*Director of the United States Patent and Trademark Office*